US009260873B1

(12) United States Patent
Curtis et al.

(10) Patent No.: US 9,260,873 B1
(45) Date of Patent: Feb. 16, 2016

(54) TRUSS MEMBER AND TRUSS CONNECTOR

(71) Applicants: Johnny Russel Curtis, Walker, LA (US); Yates Wesley Hayman, Walker, LA (US)

(72) Inventors: Johnny Russel Curtis, Walker, LA (US); Yates Wesley Hayman, Walker, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 409 days.

(21) Appl. No.: 13/848,867

(22) Filed: Mar. 22, 2013

(51) Int. Cl.
*E04G 7/30* (2006.01)
*E04G 7/02* (2006.01)

(52) U.S. Cl.
CPC ..... *E04G 7/02* (2013.01)

(58) Field of Classification Search
CPC ..... E04G 7/00; E04G 7/02; E04G 7/20; E04G 7/30; E04G 7/301; E04G 7/306; E04G 7/308; Y10T 403/30
See application file for complete search history.

(56) References Cited

U.S. PATENT DOCUMENTS

| | | | | |
|---|---|---|---|---|
| 3,992,118 | A | 11/1976 | Siegers | |
| 4,273,463 | A | 6/1981 | Dobersch | |
| 4,369,859 | A | 1/1983 | Smits | |
| 4,445,307 | A | 5/1984 | Puccinelli et al. | |
| 4,840,513 | A | 6/1989 | Hackett | |
| 5,028,164 | A | 7/1991 | Williams | |
| 5,078,532 | A | 1/1992 | Williams | |
| 5,605,204 | A | 2/1997 | Ausejo | |
| 5,617,931 | A | 4/1997 | Zygmun et al. | |
| 5,961,240 | A | 10/1999 | Bobrovniczky | |
| 6,027,276 | A | 2/2000 | Schworer | |
| 6,779,631 | B1 | 8/2004 | Hensley et al. | |
| 6,994,187 | B1 | 2/2006 | Hensley et al. | |
| 7,048,093 | B2 | 5/2006 | Wallther | |
| 7,971,686 | B1 | 7/2011 | Hayman | |
| 8,206,052 | B1 | 6/2012 | Hayman | |
| 2004/0163889 | A1 * | 8/2004 | Wallther | 182/113 |

FOREIGN PATENT DOCUMENTS

| | | | | |
|---|---|---|---|---|
| DE | 196 51 901 | * | 7/1997 | E04G 1/26 |
| JP | 2009-299307 | * | 12/2009 | E04G 1/24 |
| WO | 2011094351 A2 | | 8/2011 | |

* cited by examiner

*Primary Examiner* — Michael P Ferguson
(74) *Attorney, Agent, or Firm* — Jones Walker LLP

(57) ABSTRACT

A scaffold truss member and a scaffold truss connector. The scaffold truss member includes lower and upper horizontal members, joined by bracing members. The upper horizontal member terminates at each end with a coupling, while the lower horizontal member terminates without a coupling on either end. The scaffold truss connector includes a lower truss connector that has a channel, open on two ends to accommodate the lower horizontal member of a scaffold truss, and an upper truss connector, which is either integral or joined to the lower truss connector.

10 Claims, 7 Drawing Sheets

TRUSS MEMBER AND TRUSS CONNECTOR

BACKGROUND

Scaffold frames are a series of horizontal and vertical scaffold frame members that connect together to create a raised working platform. The overall structure is supported by the vertical scaffold members contacting the support surface, such as the ground.

Scaffold frames can be constructed from tube and clamp frame members, or from system scaffold members (modular scaffold systems). In system scaffolds, the vertical scaffold members are coupled to horizontal scaffold members at a scaffold joint. A modular scaffold joint comprises a connector on the vertical scaffold member that is designed to couple or mate with a connector on a horizontal scaffold member, thereby joining together a horizontal and vertical scaffold member. Horizontal scaffold members will be referred to in general as "horizontals," while vertical scaffold members will be referred to generally as "verticals" irrespective of the joint/connector type.

One type of modular scaffold joint uses an end connector positioned on the end of a horizontal member, where the end connector has a lip or hook section. The lip sections are designed to engage or rest on the corresponding vertical joint connector, such as an upstanding cup or an annular ring positioned on a vertical scaffold member. One such joint is disclosed in U.S. Pat. No. 4,445,307, which discloses a connector positioned on a horizontal scaffold member, where the connector has two vertically spaced hook sections. These hook sections couple with two vertically spaced upstanding cup or ring members located on the vertical scaffold member. To lock the joint in place, the connector includes a wedge that is driven (generally by a hammer) into position below the upper ring member, thereby wedging the ring against the end connector hood section, latching the horizontal member to the vertical member. This type of connector is referred to as a Safway connector. As used herein, "latching" refers to the action of engaging a horizontal member to a vertical member, where the action of latching resists dislodgement of the horizontal member from the vertical member from an upwardly directed force.

Another cup type of latching connector is disclosed in U.S. Pat. Nos. 5,078,532 and 5,028,164 and in U.S. Pat. No. 8,206,052 all hereby incorporated by reference. These patents also show an end connector positioned on a horizontal scaffold member, where the connector has two vertically spaced hooked sections that couple with two vertically spaced upstanding cup or ring members located on the vertical scaffold member. In this device, the hooked sections engage the top edge of the cup, and a pivoting member or latch, positioned on the horizontal end connector, is pivoted into position below the cup member. The latch member has a distal end extending beyond the housing, shaped to allow for placement of the distal end beneath a cup positioned on a vertical scaffold member. Hence, when latched, the cup is trapped between the hook engagement sections of the connector housing and the distal end of the latch member. The latch pivots on a pivot pin, and can be spring loaded to bias the latch into a locking or actuated position. This type of connector is referred to as an Excel connector. Single cup embodiments are also possible, such as shown in U.S. Pat. No. 7,048,093. Other cup type latching mechanisms are in the prior art, including U.S. Pat. No. 4,369,859.

Another "cup" type of latching mechanism is disclosed in U.S. application Ser. No. 11/738,273, filed Apr. 20, 2007 (hereby incorporated by reference). This application teaches a horizontal scaffold member having an end connector with two hook or engagement areas, each designed to couple with a cup on a vertical member. The connector includes an upper and a lower latch, each the respective upper and lower coupled ring or cup members. The two latches are mechanically coupled allowing for single action operation to engage or disengage both latches simultaneously. In general, a system scaffold using a cup on the vertical member with a latch on the horizontal scaffold member (whether slidable or pivotable) will be referred to as a cup/latch scaffold system. This is also in the scope of an Excel connector.

Another cup-type of latching connector is disclosed in U.S. Pat. No. 3,992,118 (commonly referred to as the Cuplock system). As disclosed in this patent (see particularly FIGS. 3 and 4 of this patent), the vertical scaffold member (generally a pipe) has a fixed annular ring 10 forming an upstanding cup surrounding the vertical member with upward facing annular channel. Positioned above this upstanding cup at a set height is a lug 20. Slidably and rotationally positioned on the vertical scaffold member above this fixed cup, is a reverse cup (a cup facing downwardly) 14 that has a downward facing annular channel, and an outward projection 18 in the cup wall that forms a slot 17. This slot accommodates the lug 2, so that the reverse cup, with the slot aligned with the lug, can slide past the lug, and if the slot is not aligned with the lug, the reverse cup cannot slide past the lug. The corresponding horizontal scaffold member (generally a pipe) has at each end, an upward facing ear or tongue 26 and a downward facing ear or tongue 27. Each respective tongue is shaped to fit in the annular channel formed in the respective upward and reverse cup. To assemble a joint, the downward tongue on the horizontal member is positioned in the upward annular channel of the upstanding cup. The reverse cup is then slid down the vertical member, past the lug 20 (by proper alignment of the slot 17), to capture the upstanding tongue within the downward facing annular on the reverse cup. The reverse cup is then rotated on the vertical member until the slot 17 is not aligned with lug 20, thereby "locking" the tongues of the horizontal member between the upstanding cup, and the reverse cup (hence the name cuplock).

Instead of upstanding cups, a flat annular ring with openings in the ring may be used as the vertical connector on the vertical scaffold member, to couple to a connector on a horizontal scaffold member. Examples of annular ring/connector systems are shown in U.S. Pat. Nos. 4,273,463; 6,027,276; 5,961,240; 5,605,204; 4,840,513; and PCT publication number WO 2011/094351, all of which are hereby incorporated by reference. These systems are generally referred to as wedge or pinlock scaffold systems. The pinlock system relies upon a wedge or pin being slidable (generally hammer driven) through the horizontal end connector and rosette. For instance, the joint of U.S. Pat. No. 5,961,240 (see FIG. 1 of that patent), uses rosette rings 16 positioned on a vertical scaffold 14 member. The ring 16 has a series of openings 22 therethrough. The horizontal end connector 10 is a body with a horizontal slot or mouth 18 in the body to accommodate the rosette ring. Slidably positioned on the horizontal end connector is a pin 20, which is vertically slidable through a vertical slot 44 and 38 in the connector body. In joining a vertical member to a horizontal member, the rosette 16 is slid into the mouth 18 of the horizontal connector, with an opening 22 in the rosette aligned with the vertical slot 44 and 38 in the end connector. The pin 20 is then rotated upwardly, and then through the vertical slots 44 and 38, which wedges and holds the horizontal member to the vertical member. Collectively, cups and rosettes, or other types of annular members on the vertical scaffold member used to couple to a horizontal end connector will be referred to collectively as annular members.

System scaffolds are used to allow for ease of erection of scaffold platforms. Two scaffold structures, each separately supported by the ground or other supporting surface, can be joined by a walkway or platform extending between the two structures. For long walkways (for instance 10-15 feet), a scaffold truss may be used as the connecting horizontal members to resist bending deformation, such as the sagging of the horizontal, that can result due to the presence of downward directed load forces over the length of the unsupported portion of the of the walkway. A scaffold truss member will have two parallel horizontal scaffold members (a lower and an upper member) with bracing members positioned between and joining the two horizontal members, such has shown in U.S. Pat. No. 5,617,931. For modular or system scaffold systems, the two ends of the truss member will have end connectors positioned thereon (generally on each end of the upper and lower truss horizontal members) that are designed to couple to a vertical scaffold annular member in the modular system. For instance, the horizontal end connector may be the Excel type with a latching connector, where the corresponding vertical connector is an upstanding cup (such as shown in FIG. 1).

Longer scaffold "walkways" can be constructed by connecting two truss members together end-to-end or serially. However, the truss connection between the two truss members has no vertical support, and hence the end-to-end truss joint is subject to compressional forces at top horizontal truss member connection and tensional forces at the bottom horizontal member truss connection, and such truss member connections are normally avoided. Hence, long scaffold walkways (over 10 feet in length) are generally not constructed absent some form of vertical support, such as overhead suspension of the truss member.

A more rigid joint to connect truss members is needed.

DESCRIPTION OF THE PREFERRED EMBODIMENT

Figure 2:
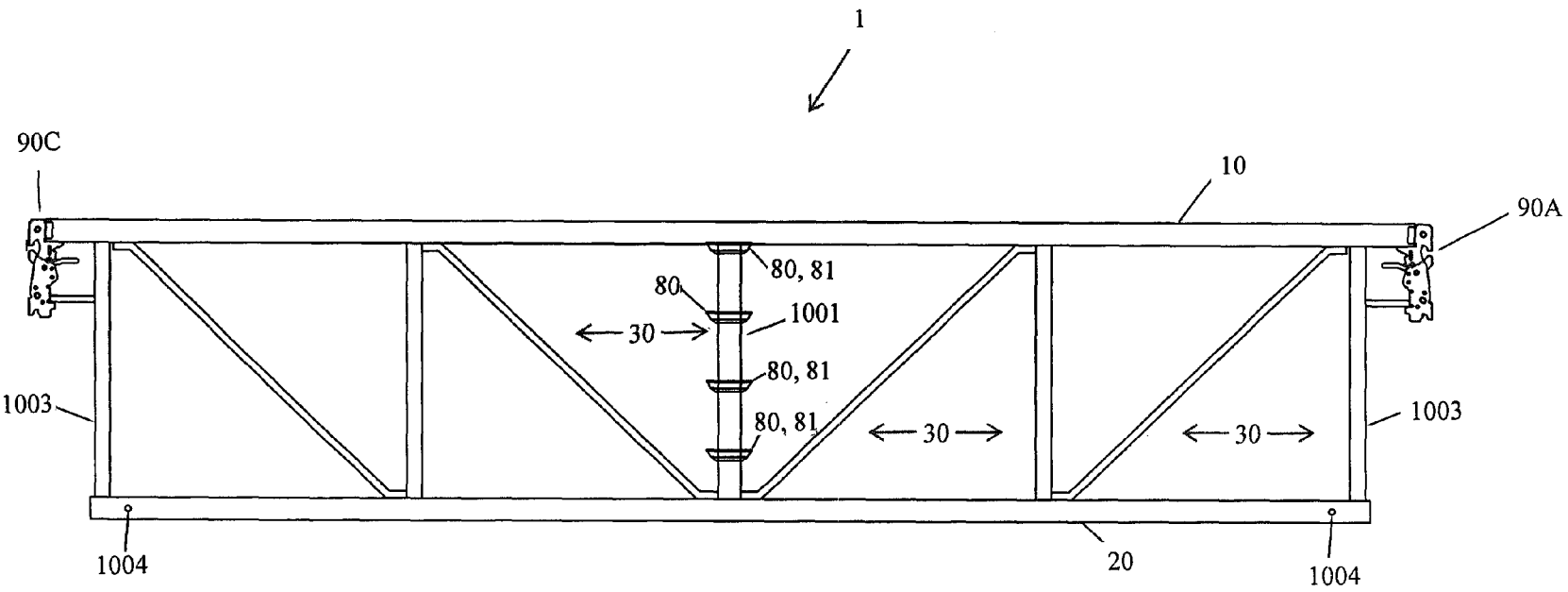
FIG. 2 is a side elevation of one embodiment of a horizontal truss member.

Shown in FIG. 2 is a horizontal scaffold truss member 1 (sometimes referred to as a truss). The truss member 1 has two parallel horizontal members, an upper member 10 and lower member 20, and support elements or bracing members 30 positioned between the two horizontal members (referred to as horizontals). In one embodiment, the horizontal members are formed from eleven gauge steel pipe (outside diameter of about 1.9 inches). Preferably, at each end of the upper horizontal 10 are end connectors 90A and 90C, forming upper connectors on upper horizontal 10. As shown, the end connectors 90A and 90C, are fixedly and non-removably joined to the respective end of the upper horizontal 10, such as by welding. Note that in the embodiment shown in FIG. 2, the lower horizontal member 20 does not terminate in an end connectors, and the lower member 20 is slightly shorter in length that the upper member 10. For convenience of description, the end connectors 90 shown are similar to those shown in FIG. 12 of U.S. Pat. No. 8,206,052, but the invention is not so limited. The "vertical" separation between the two horizontal members 10 and 20 is such that the lower truss member will not align with an annular member on a vertical scaffold. This is preferred to allow a clamp 65 to be attached to the lower member 20 to couple the lower member to a vertical scaffold member, as later described. However, a fixed end connector can be attached to the lower horizontal truss member on one terminal end only, but this is not preferred, as it makes coupling an assembled walkway to a scaffold structure more difficult.

As shown, bracing members 30 are pipes or bars that are fixedly connected (generally by welding) between the upper 10 and lower 20 members of a truss 1. The bracing members 30 can join the upper 10 and lower 20 members at a ninety degree angle (a vertical bracing member), or other angles (a diagonal bracing member), such as forty-five degrees. One of the vertical bracing members, member 1001, is formed with the annular members 80 for coupling with the respective system scaffold horizontal end connectors, here shown as upstanding cups 81. This vertical bracing member 1001 is referred to as a coupling bracing member 1001, and will be used to couple cross bracing members between the opposing sides of a scaffold walkway, each side formed with truss members 1. Preferably, the coupling bracing member 1001 is positioned about midway between the two ends of the upper and lower horizontals and are sufficient to accommodate several cross bracing members. Preferably, the truss 1 has two vertical braces 1003 that terminate near the terminal ends of the lower horizontal member 20. Shown on the terminal ends of the lower horizontal member 20 are openings 1004 through the lower horizontal 20. Bolts or other connectors will be positioned through these openings to couple the lower truss connector 50 to a truss member 1.

One embodiment for a truss connector 49 for connecting two truss members inline is shown in FIGS. 3A-D. The truss connector 49 comprises a lower truss connector 50 (shown in FIGS. 3A-C, and an upper truss connector 90, shown in FIG. 3D. The upper truss connector 90 and lower truss connectors 50 are shown removably joined together in FIG. 1.

Figure 3C:
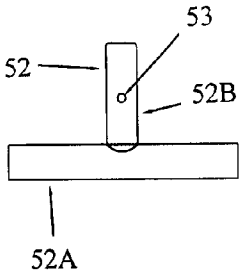
FIG. 3C is a side view of the leg member of the lower truss connector of FIG. 3A.
Figure 3A:
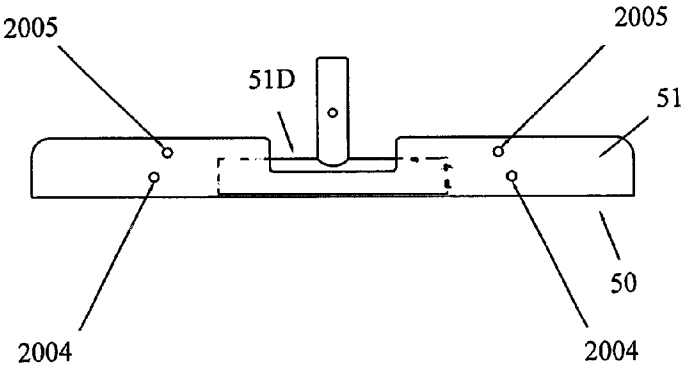
FIG. 3A is a side elevation of one embodiment of a lower truss connector.
Figure 3B:
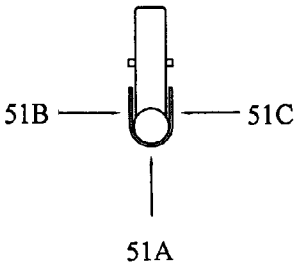
FIG. 3B is an end view of the lower truss connector of FIG. 3A.
Figure 3D:
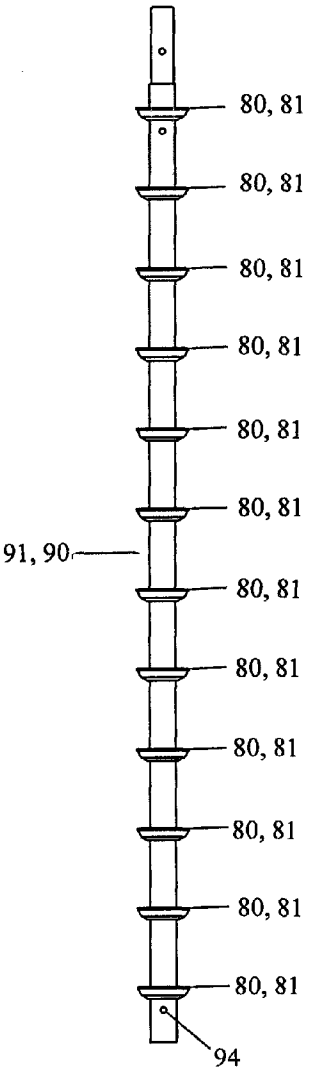
FIG. 3D is one embodiment of an upper truss connector, shown as a standard vertical member.

One embodiment of the lower truss connector 50 is shown in FIG. 3A, and is formed from two parts, a channel portion 51, and a vertical connector portion 52. In the embodiment shown, the vertical connector portion 52 (see FIG. 3C) has a bottom portion 52A, and a leg portion 52B fixedly attached to the bottom portion 52A and extending perpendicularly from the bottom portion 52A. The channel portion 51, as shown in end view of FIG. 3D, has a shaped closed bottom 51A and two sidewalls 51B and 51C that extend upwardly from the bottom 51A defining a saddle or channel interior. Sidewalls 51B and 51C are generally parallel and opposed. The bottom portion 51A is shape to cradle the bottom portion 52A of vertical connector portion 52 when it is positioned in the channel interior (centered lengthwise in the channel interior). The terminal ends of the interior of the channel 52 are not occupied by the vertical connector portion 52, but are shaped to cradle the ends of a lower horizontal member 20 of a truss member 1.

As shown, the channel 51 forms a U shaped channel or saddle along the length of the channel, with the bottom portion 51A forming a semicircle with a diameter about 2.0 inches to accommodate the lower horizontal member 20 of a truss member 1 within the channel's 51 terminal ends. In the embodiments shown, the lower truss member 10 and the bottom portion 52A are formed from eleven gauge steel pipe with outside diameter about 1.9 inches, while leg portion 52B is formed from eleven gauge steel with an outside diameter of 1.6 inches, while the channel 51 is formed by rolling ten gauge steel plate. Other sizes and shapes of the channel could be employed.

The lower truss connector 50 is formed by positioning the vertical connector portion 52 within the channel's 51 interior, centered lengthwise in the channel interior, and fixedly joining the two members, such as by welding. As shown in FIG. 3C, the two sidewalls 51B and 51C each have cutout sections 51D near the lengthwise center of the channel 51. These cutouts 51D are made to provide easy access to the top of the vertical connector portion 52 when positioned in the channel 51 to allow for welding of the two pieces 52 and 51. If the vertical connector portion 52 is joined to the channel by another technique (such as using bolts) the cutout section 51D may not be needed.

Figure 1:
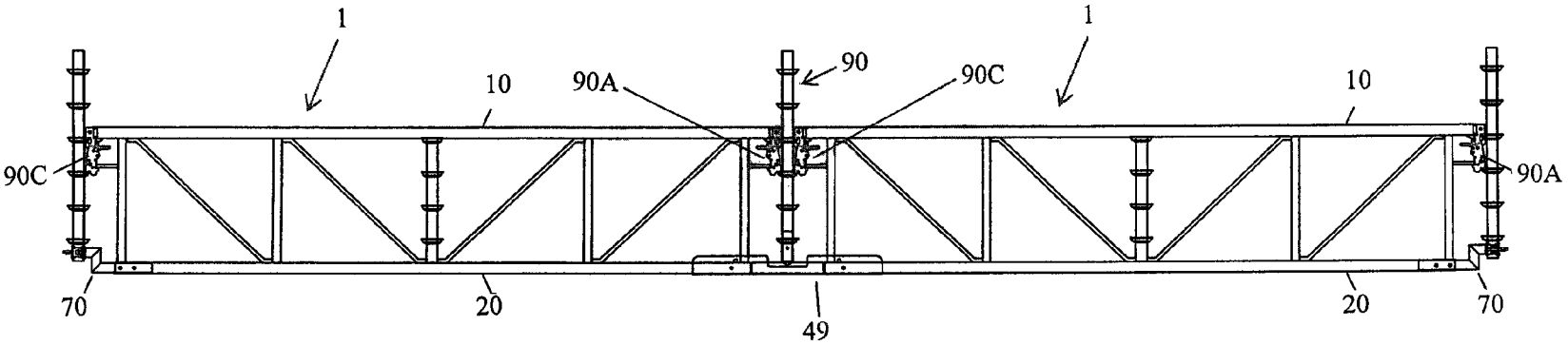
FIG. 1 is a side elevation of one embodiment of two truss members of FIG. 2 joined with a truss connector of FIG. 3.

As shown in the ghost portion of FIG. 3A, the vertical connector portion 52 does not occupy the entire interior of channel 51. The two terminal ends of the channel 51 remain open to accommodate the terminal ends of the lower horizontal member 20 of a truss member 1, when the lower truss connector 50 is positioned intermediary to two truss members 1 positioned end-to-end, as shown in FIG. 1. Also shown in FIG. 3A are openings 2004 and 2005 through the sidewalls 51B and 51C of the lower truss connector 50. When the lower truss connector 50 is positioned in place with a lower truss horizontal 20 cradled in the channel 51 terminal ends, bolts or other connectors will be inserted through these opening to fixedly and removably couple the truss member 1 to the lower truss connector 50.

Figure 6B:
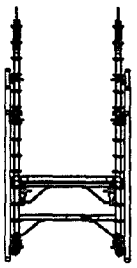
FIG. 6B is an end view of the walkway shown in FIG. 6A.
Figure 6A:
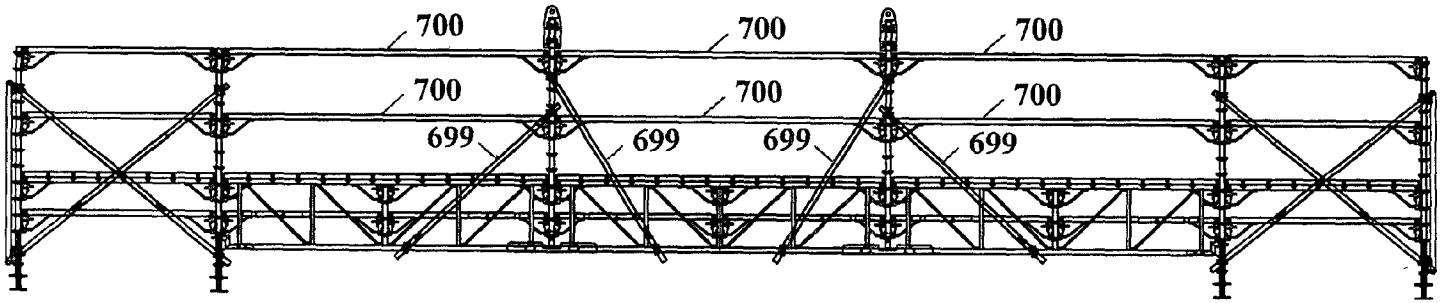
FIG. 6A is a side elevation of one embodiment of walkway formed from the truss members of FIG. 2 using the truss join of FIG. 3.

The complete truss join 49 combines the lower truss connector 50 with the upper truss connector 90. In the embodiment shown in FIG. 3D, the upper truss connector 90 is a standard vertical scaffold member 91 that is inserted over the leg portion 52B of vertical connector portion 52 (alternatively, the leg portion 52B could be sized to allow the upper truss connector 90 to be inserted into the leg portion 52B). The leg portion 52B and vertical scaffold member 91 preferably are removably latched together, such as with a bolt through both, or with a collapsable butterfly button 53 that extends through openings on the leg portion 52B and engages with openings 94 in the upper truss connector 90. As shown, the upper truss member 90 has annular members 80, as shown, annular cup 81, spaced vertically apart thereon to engage the suitable horizontal scaffold end connectors for cross bracing. The upper truss connector 90, when coupled to the lower truss connector 50, preferably extends above a coupled truss member 1, so that handrails may be attached using the annular rings 80 on the upper truss connector, such as shown in FIG. 6.

An alternative design could be to have the leg portion 52B itself comprise upper truss connector, such as by welding a vertical scaffold member to the bottom portion 52B of vertical connector, but this is not preferred. An alternative design for the lower truss connector 50 is to form a channel with a partially closed top portion in the lengthwise center (such as formed by welding a plate across the channel top to the two sidewalls). An upstanding leg would then be attached to the partially closed top for coupling to an upper truss connector 90 (not shown).

Figure 4:
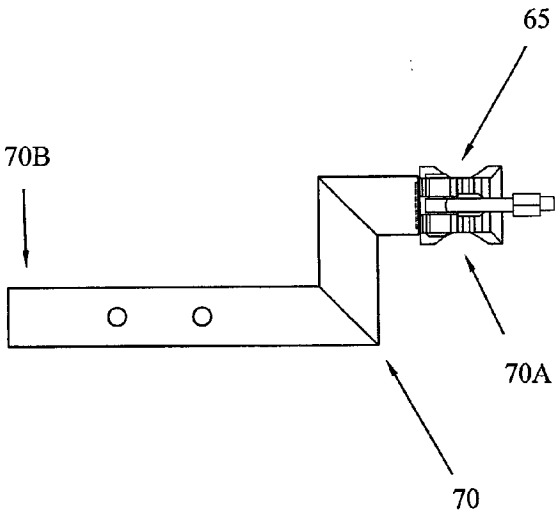
FIG. 4 is a side view of one embodiment of a lower end connector.
Figure 5:
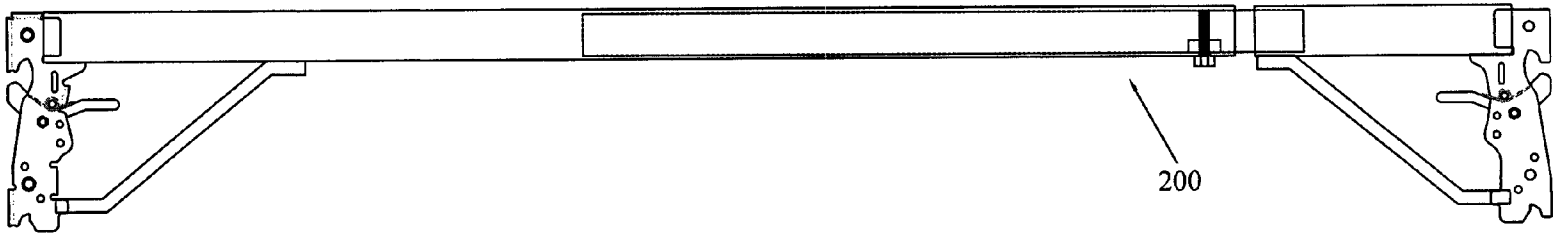
FIG. 5 shows a side view of one embodiment of an interior cross truss bracing member.

As shown in FIG. 2, both terminal ends of the lower horizontal member 20 of a truss member 1 have no integrated end connectors. To join the truss member 1 to an adjacent scaffold structure vertical member, a lower end connector should be provided 70 on one end of the lower horizontal member 20. One embodiment for a lower end connector 70 is shown in FIG. 4, and has a distal 70A and proximal 70B end. At the distal end 70A is positioned a connector body 65. As shown the connector body 65 is a U shaped clamp that is pivotally connected to the distal end 70A. The clamp is shaped to engage the vertical scaffold member when the clamp is closed and clamped to the vertical scaffold member. The proximal end 70B of the lower end connector 70 is sized to be slidably inserted into the interior of the truss lower horizontal member 20. For instance, in the embodiment shown, the proximal end 70B is formed from 1.6 inch diameter pipe.

As shown, the lower end connector 70 is not a straight connector; instead, the clamp 65 is vertically offset from the proximal end 70B of the lower end connector 70. This offset is designed to allow the end connector to be rotated into proper position to join the lower end connector 70 to an adjacent vertical member as later discussed. Alternatively, the end connector 70 could be straight, requiring that the end connector 70 be inserted into the lower horizontal member 20 prior to coupling the upper end connector 90A or 90C to a corresponding scaffold structure. Alternatively, the lower end connector 70 can be fixedly connected to the lower horizontal truss member 20, but this is not preferred.

One method used to join two truss members 1 end-to-end, the two truss members 1 are positioned with the upper horizontal members 10 and lower horizontal members 20 aligned. The upper truss connector 90 (here a scaffold vertical member 91) is then coupled to the upper end connectors 90A and 90C of the two aligned truss members 1. The annular member 81 on the vertical scaffold 91 to which the end connectors are coupled is selected so that the lower end of the upper truss connector 90 is positioned slightly above the level of the lower horizontal truss members 20. The lower truss connector 50 is then positioned below the adjacent lower horizontal member truss members 20 of the two trusses 1, slid upwardly until the terminal ends of the two lower horizontal truss members 20 are cradled in the interior of the channel 51 and the leg portion 52B is locked into place in the interior of the upper truss connector 90. Bolts are then inserted through openings 2004 and 2005.

The openings 2004 should align with openings 1004 on the lower horizontal truss member 20. The opening 2005 is positioned on the lower truss connector 50 to be above the lower horizontal member 20 when cradled in the channel of the lower truss connector 50. The opening 2005 is positioned lengthwise along the channel so that the end vertical brace 1003 of a truss member 1 will be positioned interior this opening in the channel interior. Two connecting bolts or other connectors are then inserted through the openings 2004 and 2005. Connectors inserted through aligned openings 2004 and 1004 help secure the lower truss connector 50 to the respective truss member 1 and resist twisting and bending of the lower horizontal members 20 in the channel of the lower truss connector 50. Connectors inserted through each opening 2005 are used primarily as a safety device.

Alternatively, the truss connector 48 (lower truss connector 50 and upper truss connector 90) can be joined to a first truss 1, and then a second truss 1. When upper 90 and lower 50 truss connectors are coupled to adjacent truss members 1, a join is formed with sufficient rigidity to allow multiple truss embers to be joined end-to-end. For instance, a walkway with three coupled truss members is shown in FIG. 6, where each truss is about ten feet long, allowing a walkway of thirty feet in length, sufficient to pass over a two lane roadway.

Figure 6C:
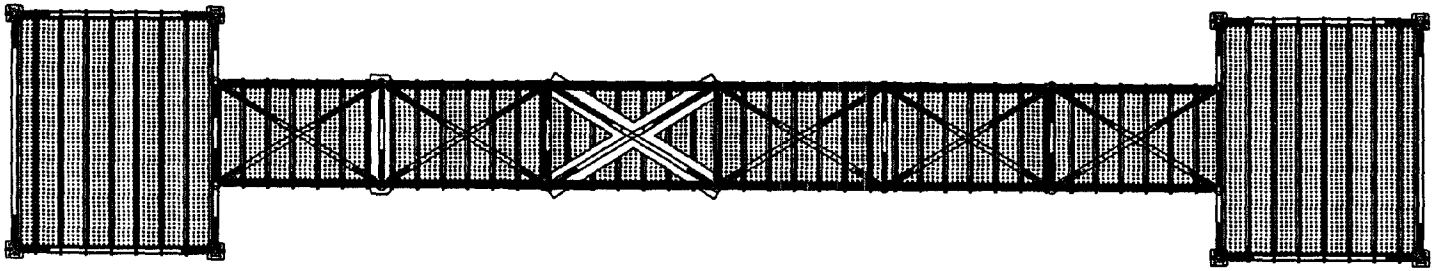
FIG. 6C is a top view of the walkway shown in FIG. 6A.

A completed walkway will have two opposing sides (each side formed from multiple truss members), cross bracing 200 between the two opposing sides, a deck surface and handrail. Cross bracing 200 will generally be fixed length horizontal scaffold members or variable length horizontal scaffold members, such as shown in FIG. 6. Cross bracing is both side to side bracing between opposing upper truss connectors, and between opposing coupling bracing members 1001 on the two opposing sides. Cross bracing can also be joined between a coupling bracing and a vertical truss connect 90 in an X type pattern as shown in the overhead view of FIG. 6C. Scaffold deck is laid across the truss members upper horizontal members 10, to form a walking surface. Hand rails 700 are attached between that portion of the vertical scaffold member 91 of the upper truss connector 90 that extends above the decking. Angled bracing 699 is additionally provided between the upper truss connector 90 and the lower truss horizontal member 20 for strength and support of the handrails.

The completed walkway is assembled on the ground, and the assembled walkway lifted by crane, using generally four point lifting with a scaffold lifting device, such as that shown in U.S. Pat. Nos. 6,994,187 or 6,779,631. The lifted walkway is then positioned adjacent to two terminal scaffold structures, such as scaffold bay 100 shown in FIG. 6. The terminal upper end connectors (90A or 90C) are then latched to a respective annular ring (here upstanding cups) on vertical scaffold members of the terminal scaffold structure.

The lower horizontal end connectors 70 are slid into the terminal ends of the walkway's lower horizontal members 20. The offset between the two ends of the lower end connector 70 allows this action. The lower end connectors are then rotated in the respective lower horizontal member 20 until the clamp 65 is adjacent a vertical scaffold member of the terminal scaffold structure, and the clamp is then coupled to that vertical scaffold member, thereby completing the walkway to the two terminal scaffold structures.

A thirty foot completed walkway has been tested with a static load of over 10,000 pounds without failing.

The invention claimed is:

1. A scaffold truss connector for coupling two scaffold truss members in an end-to-end configuration, in combination with first and second scaffold truss members, each scaffold truss member comprising:

an upper horizontal scaffold truss member and a lower horizontal scaffold truss member, each separated from the other but fixedly joined with a series of bracing members, at least one of said bracing members comprising a vertical coupling bracing member having a series of annular members adapted to couple with a horizontal scaffold member end connector, said annular members vertically spaced apart on said vertical coupling brace, said upper and said lower horizontal scaffold members having a first and second end respectively, first and second upper end connectors fixedly positioned on said first and second ends of said upper horizontal scaffold truss member, each upper end connector configured to connect to a scaffold vertical member at an annular member positioned on said vertical scaffold member;

said scaffold truss connector comprising a lower truss connector comprising a channel having two terminating open ends, a bottom portion and two sidewall portions extending from said bottom portion, said sidewall portions and said bottom portion defining an open top channel portion therebetween, at least at said two terminating ends of said channel, said channel bottom portion being shaped near each of said terminating ends to cradle a respective said lower horizontal scaffold truss member of one of said scaffold truss members when inserted into one of said terminating ends of said channel, said lower truss connector further having a leg portion that extends outwardly and substantially perpendicular to said channel bottom, said leg portion configured to releasingly engage an upper truss connector; and an upper truss connector member comprising a vertical scaffold member having a series of annular members vertically spaced apart, one of said annular members being releasingly couplable with respective said upper horizontal truss member end connectors of said scaffold truss members.

2. The combination of claim 1 wherein each upper end connector is configured to be latchable to an annular member on a scaffold vertical member.

3. The combination of claim 2 wherein the annular members are cups.

4. The combination of claim 2 wherein the annular members are rosettes.

5. The combination of claim 2 wherein said upper end connectors are slidably latchable.

6. The combination of claim 2 wherein said upper end connectors are pivotably latchable.

7. A scaffold truss connector for coupling two scaffold truss members in an end-to-end configuration, in combination with first and second scaffold truss members, each scaffold truss member comprising:

an upper horizontal scaffold truss member and a lower horizontal scaffold truss member, each separated from the other but fixedly joined with a series of bracing members, at least one of said bracing members comprising a vertical coupling bracing member having a series of annular members adapted to couple with a horizontal scaffold member end connector, said annular members vertically spaced apart on said vertical coupling brace, said upper and said lower horizontal scaffold members having a first and second end respectively, first and second upper end connectors fixedly positioned on said first and second ends of said upper horizontal scaffold truss member, each upper end connector configured to connect to a scaffold vertical member at an annular member positioned on said vertical scaffold member;

said scaffold truss connector comprising a lower truss connector comprising a channel having two terminating open ends, a bottom portion and two sidewall portions extending from said bottom portion, said sidewall portions and said bottom portion defining an open top channel portion therebetween, at least at said two terminating ends of said channel, said channel bottom portion being shaped near each of said terminating ends to cradle a respective said lower horizontal scaffold truss member of one of said scaffold truss members when inserted into one of said terminating ends of said channel, said lower truss connector further having a leg portion that extends outwardly and substantially perpendicular to said channel bottom, said leg portion further forming an upper truss connector, and having a series of annular members vertically spaced apart on said leg portion, one of said annular members being releasingly couplable with respective said upper horizontal truss member end connectors of said scaffold truss members.

8. A method of assembling first and second scaffold truss members in an end-to end configuration; comprising the steps of:

providing first and second scaffold truss members, each comprising: an upper horizontal scaffold truss member and a lower horizontal scaffold truss member separated from the other but fixedly joined with a series of bracing members, at least one of said bracing members comprising a vertical coupling bracing member having a series of annular members adapted to couple with a horizontal scaffold member end connector, said annular members vertically spaced apart on said vertical coupling brace, said upper and said lower horizontal scaffold members having a first and second end respectively, first and second upper end connectors fixedly positioned on said first and second ends of said upper horizontal scaffold truss member, each upper end connector configured to connect to a scaffold vertical member at an annular member positioned on said vertical scaffold member;

providing a lower truss connector comprising a channel having two terminating open ends, a bottom portion and two sidewall portions extending from said bottom portion, said sidewall portions and said bottom portion defining an open top channel portion therebetween, at least at said two terminating ends of said channel, said channel bottom portion being shaped near each of said terminating ends to cradle a respective said lower horizontal scaffold truss member of one of said scaffold truss members when inserted into one of said terminating ends of said channel, said lower truss connector further having a leg portion that extends outwardly and substantially perpendicular to said channel bottom, said leg portion configured to releasingly engage an upper truss connector;

providing an upper truss connector comprising a vertical scaffold member having a series of annular members vertically spaced apart, one of said annular members being releasingly couplable with respective said upper horizontal truss member end connectors of said scaffold truss members;

coupling said first end of said upper scaffold truss member of said first scaffold truss member to said upper truss connector;

coupling said second end of said upper scaffold truss member of said second scaffold truss member to said upper truss connector;

cradling said first end of said lower scaffold truss member of said first scaffold truss member in said lower truss connector;

cradling said second end of said lower scaffold truss member of said second scaffold truss member in said lower truss connector; and coupling said lower truss connector to said upper truss connector.

9. The method of claim 8 further comprising the step of locking said lower truss connector to said upper truss connector.

10. The method of claim 9 further comprising the steps of bolting said lower truss connector to said first and second scaffold truss members.

* * * * *